US005735786A

United States Patent [19]

Krueger et al.

[11] Patent Number: 5,735,786

[45] Date of Patent: Apr. 7, 1998

[54] METHOD AND APPARATUS FOR AUTOMATICALLY LINING A CONTAINER

[75] Inventors: Friedrich Krueger, San Jose; Robert Johnson, Santa Clara, both of Calif.

[73] Assignee: K & R Equipment, Inc., San Jose, Calif.

[21] Appl. No.: 742,513

[22] Filed: Nov. 1, 1996

[51] Int. Cl.[6] ..... B31B 7/00

[52] U.S. Cl. ..... 493/101; 53/175; 53/386.1

[58] Field of Search ..... 493/95, 99, 100, 493/101; 53/175, 386.1

[56] References Cited

U.S. PATENT DOCUMENTS

| | | | |
|---|---|---|---|
| 3,523,492 | 8/1970 | Bruce | 93/36.01 |
| 3,592,004 | 7/1971 | Lense | 53/358 |
| 3,653,111 | 4/1972 | Bruce | 493/100 |
| 3,672,122 | 6/1972 | Berger et al. | 53/384 |
| 4,009,646 | 3/1977 | Mott | 93/36.01 |
| 4,015,515 | 4/1977 | Johnson | 93/8 |
| 4,052,931 | 10/1977 | Morse | 493/101 |
| 4,083,293 | 4/1978 | Goldstein | 493/100 |
| 4,142,453 | 3/1979 | Gidewall | 493/100 |
| 4,430,068 | 2/1984 | Vom Hofe | 493/101 |
| 4,522,012 | 6/1985 | Nelson | 53/175 |
| 4,537,584 | 8/1985 | Everman | 493/101 |
| 4,723,935 | 2/1988 | Furukawa | 493/100 |
| 4,729,209 | 3/1988 | Owensby | 493/100 |
| 4,735,031 | 4/1988 | Langen | 493/101 |
| 4,795,413 | 1/1989 | Johnson | 493/101 |
| 4,874,354 | 10/1989 | Johnson | 493/101 |
| 5,059,084 | 10/1991 | Krein | 414/467 |
| 5,199,246 | 4/1993 | Rodrigo | 53/175 |
| 5,279,537 | 1/1994 | Lilie | 493/100 |

FOREIGN PATENT DOCUMENTS

| | | | |
|---|---|---|---|
| 100829 | 10/1961 | Netherlands | 81/1 |

*Primary Examiner*—Jack W. Lavinder
*Attorney, Agent, or Firm*—Medlen & Carroll, LLP

[57] ABSTRACT

The present invention provides for a method and apparatus for automatically lining a container having at least one open end. A bag-type liner having a sealed and unsealed end is suspended in the container with the sealed end down. A plurality of clamps grab the sides of the bag and open the unsealed end by pulling the sides apart. Air is then withdrawn from between the liner and container thereby expanding the liner in the container. If the container has two oppositely facing open ends, a vent can be positioned under one of the open ends for drawing air out from the container. If the container has only one open end, a plurality of vacuum robes can be inserted at the four corners of the container between the liner and the container for drawing air out from between the liner and container.

11 Claims, 9 Drawing Sheets

METHOD AND APPARATUS FOR AUTOMATICALLY LINING A CONTAINER

FIELD OF THE INVENTION

The present invention relates to methods and equipment for lining containers. In particular, the present invention provides a method and apparatus for automatically opening and inserting a bag-type liner into a container.

BACKGROUND OF THE INVENTION

A thin plastic liner or the like is often employed in a shipping box or other container to increase the shelf-life of foods or other perishable commodities or to prevent leakage or spillage of product from a sealed shipping container. Such plastic liners are often in bag form.

A common method of lining containers has been to manually place the liner over the open end of the container and then drawing the liner into the container using a vacuum as shown in U.S. Pat. No. 4,052,931 to Morse et al., or by blowing the liner into the container as shown in U.S. Pat. No. 4,537,584 to Everman et al. Attempts have also been made to automatically open the liner before placing the liner over the open end of the container by using a vacuum assembly as shown in U.S. Pat. No. 4,522,012 to Nelson, U.S. Pat. No. 4,083,293 to Goldstein, and U.S. Pat. No. 4,537,584 to Everman et al. However, the use of such vacuum assemblies in a totally automated lining process has been problematic. Vacuum cup or vacuum bar assemblies in totally automatic assemblies do not provide a positive grasp on each side of the liner to enable the sides of the liner to be completely pulled apart. In addition, simply separating the sides of the bag at the open end does not completely open the bag since the sides of the bag tend to cling together due to surface tension or other adhesion between the inner surfaces of the liner. If the liner is not completely opened before it is placed over the container, the liner can tear. Attempts to break such surface tension or adhesion while using vacuum cups or bars to separate the sides of the liner have been unsuccessful.

Another method is disclosed in U.S. Pat. No. 5,059,084 to Krein. There, two methods are discussed for installing a liner in a semi-tractor trailer. In the first method, an unopened liner is manually unrolled into the trailer with the open end facing the entrance of the trailer (no discussion is provided on how the liner will be unrolled or by what mechanism). A blower is secured to the open end and the liner inflated. When the liner is fully expanded, the open end can be sealed against the entrance using, for example, tension bars 28 and 30. In an alternative embodiment shown in FIG. 8 (see col. 5 line 8), the liner is unrolled and the open end is sealed against the entrance. A vacuum is drawn through a pair of vertical vacuum members 24 inserted at the rear of the trailer near the door hinges. These members evacuate the air in the trailer, drawing the liner up against the trailer wall. Krein suggests that other kinds of vacuum arrangements can be used, such as horizontal members extending from the door of the trailer back into the rear of the container. However, Krein does not disclose whether such members would be permanently installed in the trailer, or simply inserted during the procedure. If the latter, Krein does not suggest where the members would be located or how they would be inserted and withdrawn.

Yet another method is described in U.S. Pat. No. 4,874,354 to Johnson et al. There, a liner is positioned above a container with the liner opening facing toward the container. A jaw assembly grasps the liner and fits the unsealed end of the liner around the opening of the container; subsequently, the liner is inverted into the container using a vacuum created in the container using a plenum over which the container has been positioned. Once in the container, the liner expands in the inverted configuration to line the inside of the container. A drawback with this invention is that there must be sufficient room above the container to accommodate the jaw assembly and an extended liner while the liner is being cuffed to the container. This is apparent from FIG. 1 of the '354 patent wherein the liner is in an extended configuration as it is being cuffed to the container. If the liner is not extended, the vacuum plenum will not be able to efficiently draw the bag into the container. Furthermore, this invention will only work if the container is substantially open at the bottom for providing access of the plenum to the inside of the container. Still further, with this device, the liner is inverted in the container. This can cause a configuration problem if a specific side of the liner must contact the inner surface of the container. For example, if one side of the liner is more or less water permeable.

What is therefore needed is a quick and reliable method and apparatus for lining a container having one or two openings. Furthermore, the apparatus must also be compact so as to minimize its space requirements. Still further, the apparatus must allow for lining of a container without inverting the liner during the lining process.

SUMMARY

The present invention contemplates a method for lining containers with a flexible bag-type liner comprising the steps of: providing a flexible bag-type liner having a sealed end and an unsealed end, a container having at least a first open end, a plurality of clamps, and a means for drawing air from said container; suspending the liner in the container with the sealed end inside the container and the unsealed end outside the container; grabbing the unsealed end of the liner with the clamps; pulling the clamps apart to open the unsealed end of the liner; and actuating the means for drawing air from the container to open the liner in the container.

In one preferred embodiment of the method of the present invention, the method further comprises the step of cuffing the unsealed end of the liner over the open end of the container. In another preferred embodiment, the means for drawing air comprises a vacuum plenum over which the container is positioned during lining. In yet another preferred embodiment, said means for drawing air from said container comprises a plurality of tubes communicating with a vacuum generator, said tubes inserted into the container through the open end, before the actuating step.

In an alternative preferred embodiment, the present invention contemplates a method for lining containers with a flexible bag-type liner comprising the steps of: providing a continuous source of flexible liner having a generally tubular shape, a leading sealed end; a cutting and sealing means; a container having at least a first open end; a plurality of clamps; and a means for drawing air from said container; dropping the sealed end of the liner through the first open end and into the container; engaging the liner with the curing and shaping means a predetermined distance from the sealed end, thereby cutting off a section of the liner to form an unsealed end, and creating a new sealed edge on the continuous flexible liner; grabbing the unsealed end of the liner with the plurality of clamps; pulling the clamps apart to open the unsealed end of the bag; and actuating the means for drawing air to draw air out of the container from between the bag and the container, thereby fully opening the bag into the container.

In one preferred embodiment, the method further comprises the step of, after the actuating step, cuffing the unsealed end of the liner over the open end of the container. In another preferred embodiment, the means for drawing air comprises a vacuum plenum over which the container is positioned during lining. In yet another preferred embodiment, the means for drawing air comprises a plurality of vacuum tubes inserted into the container through the open end, before the actuating step.

The present invention also contemplates an apparatus for lining containers having one or more walls and at least a first open end, comprising: means for feeding a flexible bag-type liner having walls, a sealed end and an unsealed end, through the first open end and into the container, sealed end first; a clamping means for grabbing the unsealed end of the liner and separating the walls at the unsealed end of the liner; and a vacuum means for drawing air out of the container from between the liner and the container, for fully opening the liner in the container.

In one preferred apparatus embodiment, the vacuum means comprises a vacuum plenum over which the container is positioned during lining. In another preferred apparatus embodiment, the means for drawing air comprises a plurality of vacuum tubes moveable into and out of the container through the first open end and between the liner and the walls of the container.

DETAILED DESCRIPTION OF THE PREFERRED EMBODIMENT

The following description serves to illustrate a preferred embodiment and aspects of the present invention and is not to be construed as limiting the scope thereof.

In considering the method and apparatus of the present invention some definitions are helpful. For example, "cuffing" refers to the process of forming a cuff of the flexible liner along the outside open edge of the container. A "means for drawing air" refers to any means for drawing air from a container. This means does not necessarily create a vacuum but instead may include a means for creating a near vacuum condition. "Grabbing" refers to the clamps of the present invention engaging the sides of the plastic liner. An illustration of a suitable clamp and typical grabbing action can be seen in U.S. Pat. No. 4,874,354 to Johnson et al., which is hereby incorporated by reference.

"Inverting the liner/bag" refers to turning the liner/bag inside-out. "Vacuum tubes" refer to tubes that are coupled to a device for drawing air (i.e. a vacuum cleaner, a reversible blower, a fan blade). The tubes can have any cross sectional shape.

Figure 1:
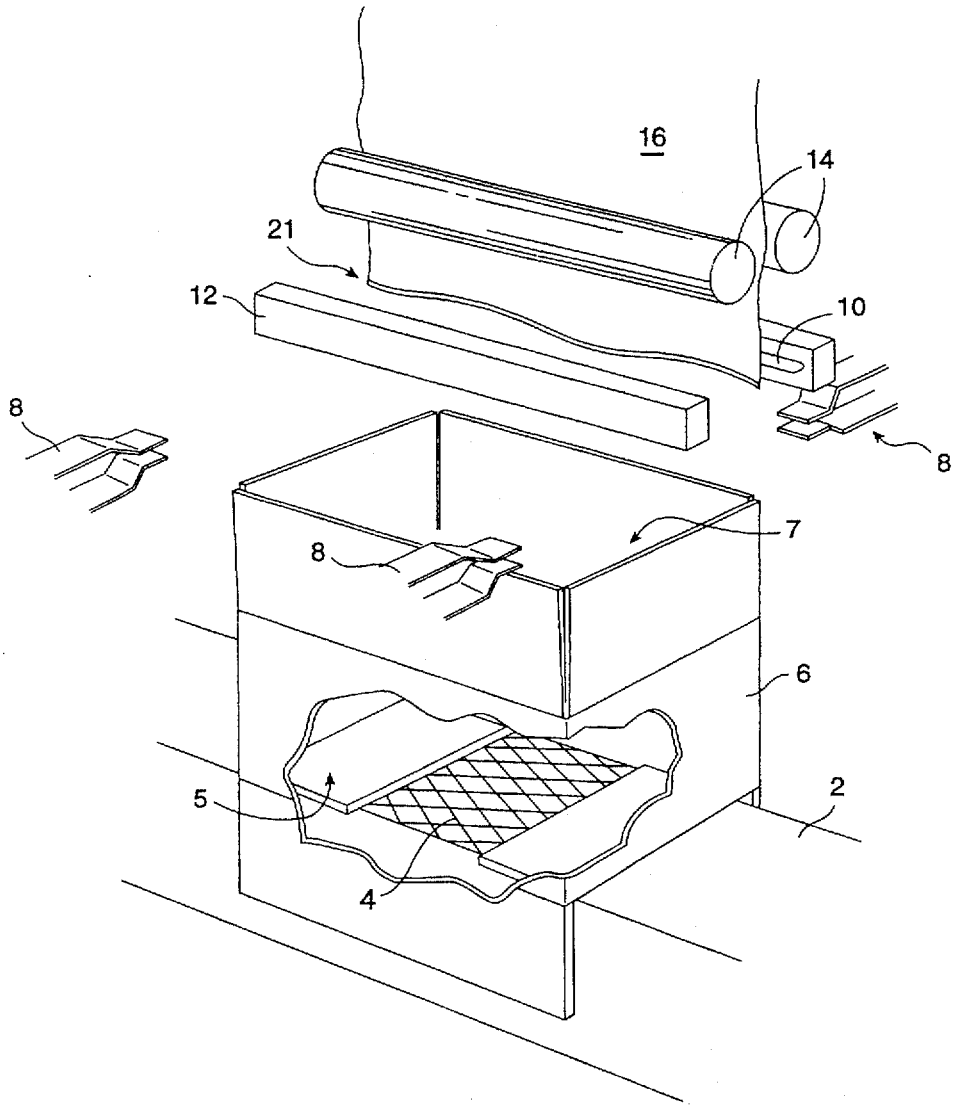
FIG. 1 illustrates a perspective drawing of a preferred embodiment of the present invention.

FIG. 1 illustrates a perspective drawing of a preferred embodiment of the present invention. Specifically, the device comprises a conveyor 2 for supporting a container 6 such as a typical cardboard box. As with many cardboard boxes, the container 6 has a set of four flaps on the top and bottom for sealing the box. The container is placed on the conveyor 2 with at least two of the bottom flaps open so that the inside of the container is exposed to the vent 4. The vent 4 is coupled to any conventional means for drawing air from the inside of the container (i.e. for creating a vacuum or near vacuum condition). For example, a fan can be incorporated to draw air from the inside of the container 6.

Positioned above the container 6 are two rollers 14 for feeding a flexible liner 16 (i.e. a plastic or latex liner), having a sealed end 21. Although illustrated here as employing two rollers, it should be apparent to one skilled in the art that any means for feeding a flexible liner can be used and this invention is not limited to a particular number of rollers or to rollers at all.

A clamp cylinder 12 and a knife 10 are preferably located directly beneath the rollers 14 for cutting off a section of the liner and sealing the bottom edge of the next liner 24. The clamp cylinder 12 and knife 10 are designed in such a manner that a sealing means is located above a cutting means. This allows the clamp cylinder 12 and knife 10 combination remove a section of the liner wherein the liner section has an unsealed top 22, while the remaining liner is sealed at its bottom. By sealing the bottom of the remaining liner, the present invention ensures that upon the next cycle, the next liner section will have a sealed bottom edge 24. Any conventional and well known sealing means can be used such as those used to seal plastic food bags (i.e. a heated metal or composite strip). The cutting edge can be any edge sharp enough to cut through the liner. Alternatively, a roll of pre-sealed liners with perforations for separating one liner from the next can be used with the present invention.

Below the clamp cylinder 12 and knife 10 are clamps 8 for engaging the liner section and spreading open the unsealed end 22 of the liner section. Although the clamps 8 can be of any design for gripping the sides of a liner and separating them, an example of a suitable design is illustrated in U.S. Pat. No. 4,874,354 to Johnson et al., hereby incorporated by reference. Furthermore, it is contemplated in the preferred embodiment that four clamps 8 be incorporated roughly located above the four corners of the container 6. This does not preclude, however, the application of more or less clamps or different positions of the clamps 8.

Figure 2A:
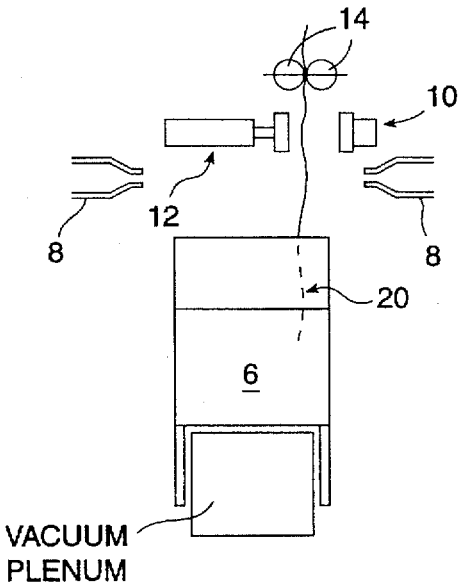
FIGS. 2*a–g* illustrates the sequence of steps performed by the preferred embodiment when lining a container.
Figure 2B:
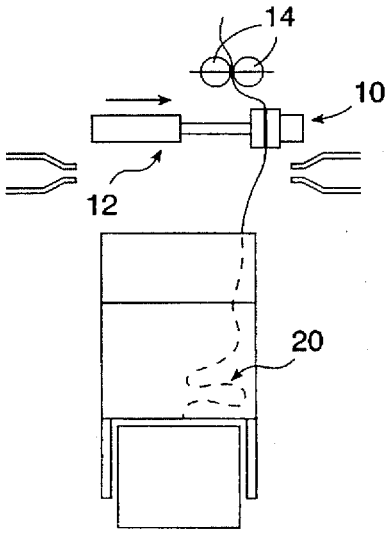
Figure 2C:
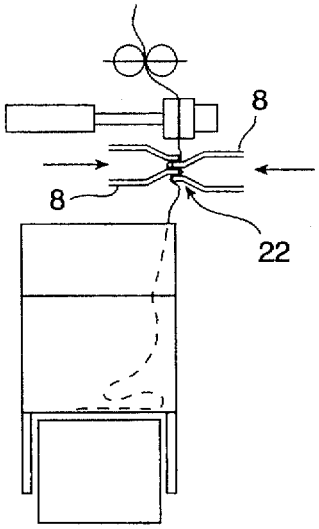

FIGS. 2*a–g* illustrate this preferred embodiment in operation. In FIG. 2*a*, the conveyer 2 positions a new container 6 below clamps 8 while the two rollers 14 feed a length of liner 16 (sealed end 21 first) into the container 6 through open end 7. When the appropriate length has been fed, the clamp cylinder 12 and knife 10 engage the liner 16 thereby cutting a section of the liner 16 and sealing the bottom edge 24 of the next liner in FIG. 2*b*. While the clamp cylinder 12 and knife 10 are still engaged, the clamps 8 grip the liner section below the clamp cylinder 12 and knife 10 in FIG. 2*c*. It should be noted that while shown here in this order, the present invention should work equally well if the clamps 8 grip the liner before the clamp cylinder 12 and knife 10 engage. It should a/so be noted that while a minimum of two clamps 8 are necessary for proper operation, additional clamps may also be incorporated.

Figure 2D:
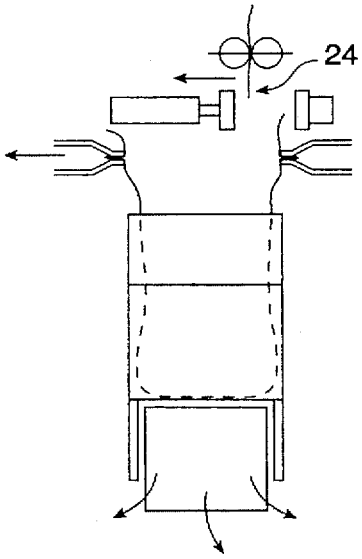
Figure 2E:
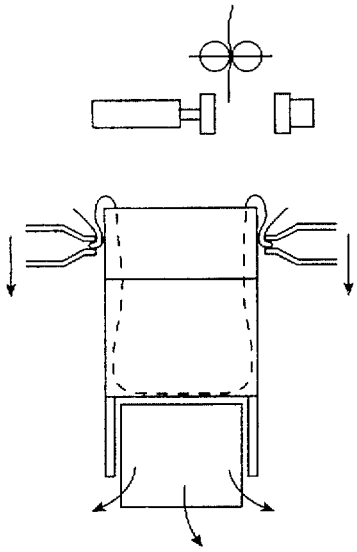
Figure 2F:
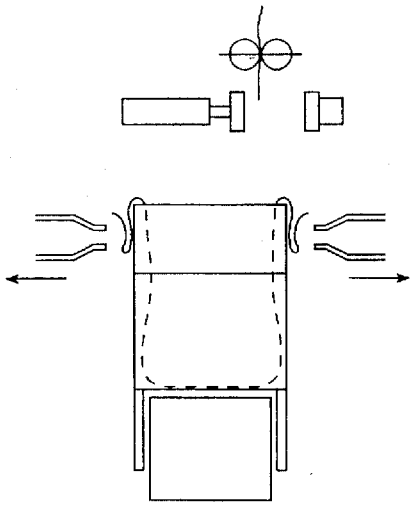
Figure 2G:
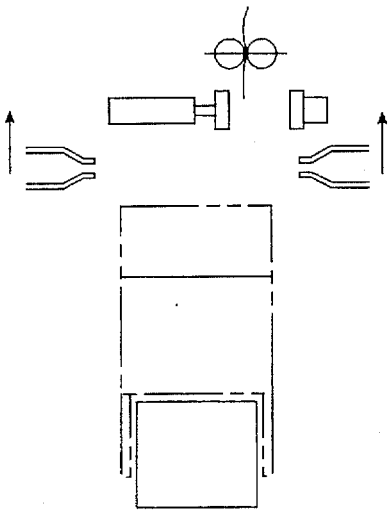

In FIG. 2*d*, the clamps 8 open the liner section by spreading apart the sides of the liner section. A vacuum or near vacuum condition is then created in the container by removing air from the container through open end 5 via the vent 4. This draws the walls of the liner against the inside of the container. The clamps 8 then cuff the liner section over the top of the container by pulling the ends of the liner section down around the outside of the open end 7 of the container 6 in FIG. 2*e*. Once the liner section has been cuffed, the clamps 8 open and clear the container 6 in FIG. 2*f* and the vacuum is stopped. Finally, the clamps 8 return to their original position as a new container is moved into position as shown in FIG. 2*g*. It should be noted that while this embodiment describes the vacuum as preferably expanding the liner section in FIG. 2*d*, such expansion could also occur at step 2*e* or 2*f* and possibly at step 2*g*.

Figure 3:
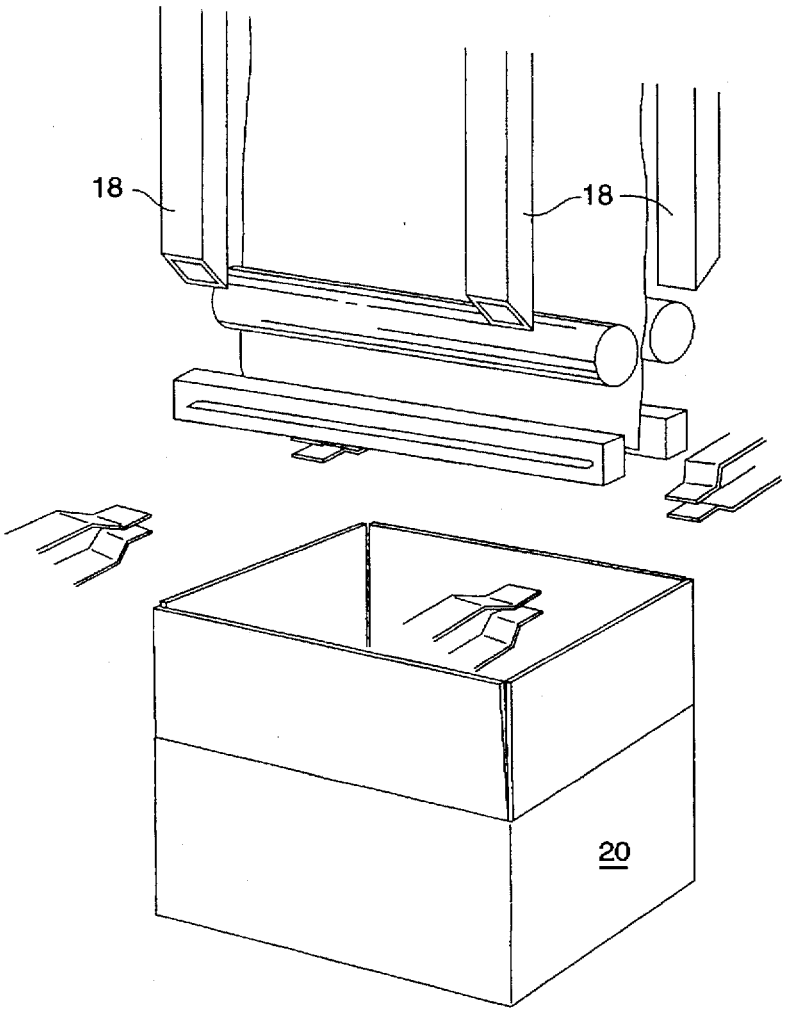
FIG. 3 illustrates a perspective drawing of an alternative preferred embodiment of the present invention.

An alternate preferred embodiment is illustrated in FIGS. 3 and 4. FIG. 3 is a perspective diagram of the alternate preferred embodiment which is similar to FIG. 1 and having similar elements. Specifically, elements 8, 10, 12, 14, 16, 21, 22 and 24 are the same as the similarly numbered elements from FIGS. 1 and 2. Two significant distinctions between this embodiment and the previous embodiment are that this embodiment incorporates vacuum tubes 18 and it can be utilized on a container 20 having a closed bottom.

The vacuum tubes 18 are any tubes which are sufficiently able to draw air from a container. For example, the tubes may be coupled to a fan or vacuum plenum having sufficient suction power to expand the liner section in the container. Furthermore, although the vacuum tubes 18 are illustrated as having a square cross section, they can have any cross sectional shape such as a circle, hexagon, oval, etc. The container 20 can be, although is not limited to, a cardboard box similar to container 6 illustrated in FIGS. 1 and 2, except that the bottom flaps are closed and/or sealed. Furthermore, the container 20 can be placed on a conveyor belt for automatic positioning of a new containers at the start of each cycle.

Figure 4A:
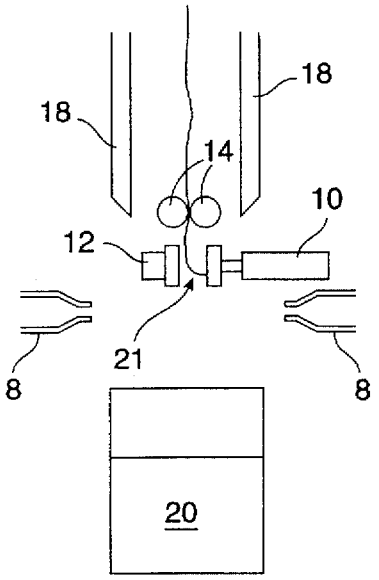
FIGS. 4*a–h* illustrate the sequence of steps performed by the alternative embodiment when lining a container.
Figure 4B:
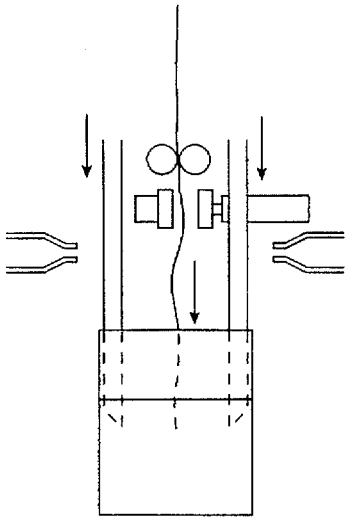

FIGS. 4*a–h* illustrate one cycle of the alternate preferred embodiment in operation. FIG. 4*a* illustrates the position of the different elements of this embodiment at the start of a cycle when a new container 6 is positioned. At FIG. 4*b*, rollers 14 feed a length of the liner 16 into the container while the vacuum tubes 18 are lowered into the container 20 at its four corners. It should be noted that while described here as being inserted at the container's four corners, it is also contemplated that the vacuum tubes 18 be inserted at points other than the four corners or at only one, two or three corners. Furthermore, it is also contemplated that fewer than four vacuum tubes could be utilized.

Figure 4C:
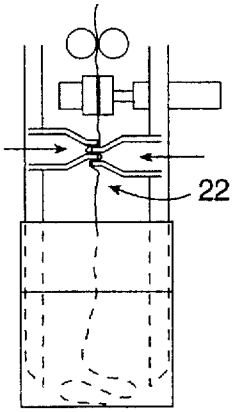
Figure 4D:
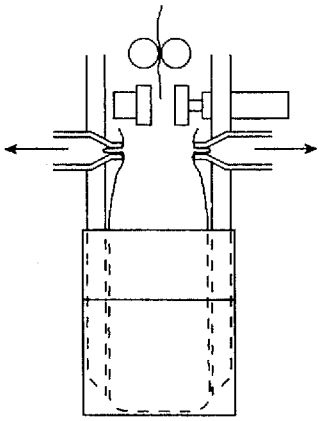

In FIG. 4*c*, a clamp cylinder 12 and knife 10 are preferably provided to engage the liner 16 and cut a section of the liner 16 while simultaneously sealing the bottom end 24 of the next liner. However, as noted above, it would be possible to use pre-sealed liners perforated for easy separation. The clamps 8 also grab the unsealed end of the liner section during this step. In FIG. 4*d*, the clamp cylinder 12 and knife 10 disengage and the clamps 8 and draw open the sides of the liner section. Meanwhile, the vacuum tubes 18 are activated to draw air from the space between the sides of the liner section and the sides of the container 20, thus forming a vacuum. This vacuum causes the walls of the liner section to be dram against the walls of the container.

Figure 4E:
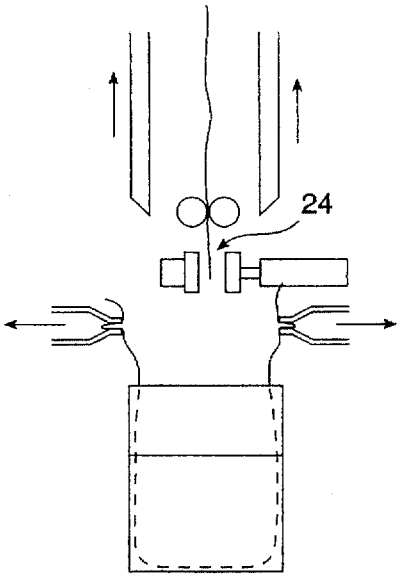
Figure 4F:
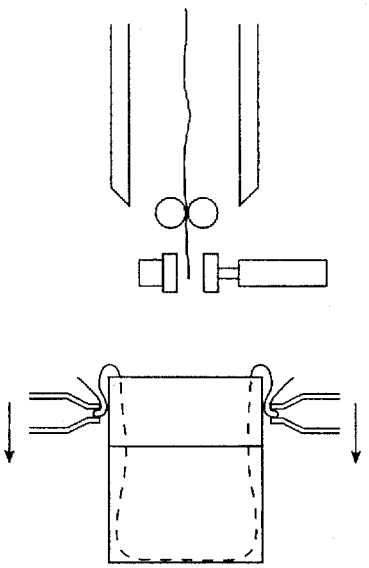
Figure 4G:
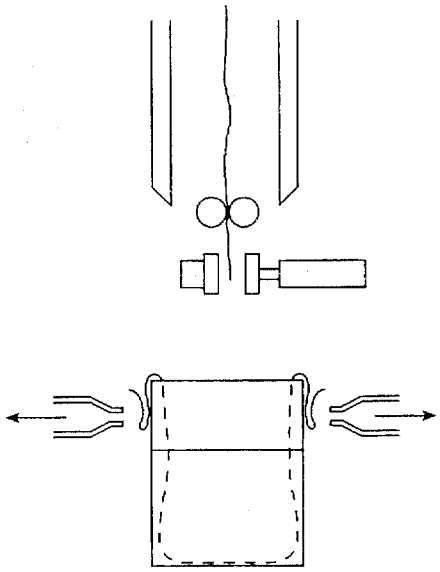
Figure 4H:
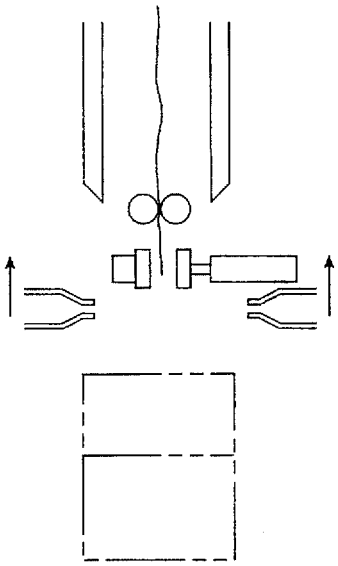

As shown in FIG. 4*e*, the vacuum tubes 18 can then be deactivated and then removed from the container 20, as the clamps cuff the liner section by pulling the end of the liner section down over the sides of the container 20 as shown in FIG. 4*f*. The clamps 8 then release the liner section (FIG. 4*g*) and return to their start position in FIG. 4*h*. The container is then transported to a different location while a new container is positioned to be lined and the process is repeated.

In should be noted that in both preferred embodiments, a liner section that has previously been cut to size, can be utilized. This would eliminate the need for the clamp cylinder 12 and knife 10. Furthermore, it should be noted that the liner is not limited to plastic or latex, but may be composed of any material flexible enough to be expanded by a vacuum or near vacuum condition.

From the above, it is clear that the present invention provides a quick and reliable method and apparatus for lining a container having one or two openings. Furthermore, the apparatus minimizes its space requirements because the space above the container does not have to be large enough to hold a fully extending liner. Still further, the apparatus allow for the lining of a container without having to invert the liner during the lining process.

We claim:

1. A method for lining containers with a flexible bag-type liner comprising the steps of:

a. providing a flexible bag-type liner having a sealed end and an unsealed end, a container having at least a first open end, a plurality of clamps, and a means for drawing air from said container;

b. suspending the liner in the container with the sealed end inside the container and the unsealed end outside the container;

c. grabbing the unsealed end of the liner with the clamps;

d. pulling the clamps apart to open the unsealed end of the liner; and e. actuating the means for drawing air from the container to open the liner in the container.

2. The method of claim 1, further comprising the step of cuffing the unsealed end of the liner over the open end of the container.

3. The method of claim 1, wherein the means for drawing air comprises a vacuum plenum over which the container is positioned during lining.

4. The method of claim 1 wherein said means for drawing air from said container comprises a plurality of tubes communicating with a vacuum generator, said tubes inserted into the container through the open end, before the actuating step.

5. A method for lining containers with a flexible bag-type liner comprising the steps of:

a. providing a continuous source of flexible liner having a generally tubular shape, a leading sealed end; a cutting and sealing means; a container having at least a first open end; a plurality of clamps; and a means for drawing air from said container;

b. dropping the sealed end of the liner through the first open end and into the container;

c. engaging the liner with the cutting and shaping means a predetermined distance from the sealed end, thereby cutting off a section of the liner to form an unsealed end, and creating a new sealed edge on the continuous flexible liner;

d. grabbing the unsealed end of the liner with the plurality of clamps;

e. pulling the clamps apart to open the unsealed end of the bag; and f. actuating the means for drawing air to draw air out of the container from between the bag and the container, thereby fully opening the bag into the container.

6. The method of claim 5, further comprising the step of, after the actuating step, cuffing the unsealed end of the liner over the open end of the container.

7. The method of claim 5, wherein the means for drawing air comprises a vacuum plenum over which the container is positioned during lining.

8. The method of claim 5 wherein the means for drawing air comprises a plurality of vacuum tubes inserted into the container through the open end, before the actuating step.

9. An apparatus for lining containers having one or more walls and at least a first open end, comprising:

a. means for feeding an unopened flexible bag-type liner having walls, a sealed end and an unsealed end, through the first open end and into the container, sealed end first;

b. a clamping means for grabbing the unsealed end of the liner and separating the walls at the unsealed end of the liner after the sealed end of the liner has been inserted into the container; and c. a vacuum means for drawing air out of the container from between the liner and the container, for fully opening the liner in the container.

10. The apparatus of claim 9, wherein the vacuum means comprises a vacuum plenum over which the container is positioned during lining.

11. The apparatus of claim 9 wherein the means for drawing air comprises a plurality of vacuum tubes moveable into and out of the container through the first open end and between the liner and the walls of the container.

* * * * *